United States Patent [19]

Gotberg

[11] 4,278,308

[45] Jul. 14, 1981

[54] DRAWER ASSOCIATING CONSTRUCTION

[75] Inventor: John Gotberg, Franklin, Mich.

[73] Assignee: Gotbert Patent Company, Farmington Hills, Mich.

[21] Appl. No.: 949,076

[22] Filed: Oct. 6, 1978

[51] Int. Cl.[3] ..... A47B 88/00

[52] U.S. Cl. ..... 312/330 R; 312/246; 312/298; 312/350; 232/1 D

[58] Field of Search ..... 312/330 R, 350, 258, 312/205, 229, 199, 200, 298, 301, 246, 211, 310; 232/1 D; 5/236

[56] References Cited

U.S. PATENT DOCUMENTS

| | | | |
|---|---|---|---|
| 88,977 | 4/1869 | Muller | 5/236 |
| 232,127 | 9/1880 | Hicks | 312/258 |
| 274,418 | 3/1883 | Van Hutton | 312/258 |
| 321,586 | 7/1885 | Deming | 312/330 R |
| 405,630 | 6/1889 | Vardon | 312/298 |
| 1,342,269 | 6/1920 | Stewart | 312/258 |
| 1,370,167 | 3/1921 | Thompson | 232/1 D |
| 1,647,275 | 11/1927 | Cursons | 232/1 D |
| 3,294,307 | 12/1966 | Munroe | 312/258 |
| 3,576,355 | 4/1971 | Stone | 312/258 |
| 3,588,209 | 6/1971 | Nathan | 312/258 |
| 3,594,058 | 7/1971 | Kauffman | 312/298 |
| 3,744,869 | 7/1973 | Anderson et al. | 312/350 |
| 3,797,906 | 3/1974 | Gutner | 312/330 R |
| 4,077,685 | 3/1978 | Scire et al. | 312/246 |
| 4,082,391 | 4/1978 | Turner | 312/228 |

*Primary Examiner*—Victor N. Sakran

*Attorney, Agent, or Firm*—Cushman, Darby & Cushman

[57] ABSTRACT

One or more upper hung drawers in a single tier as in a file cabinet or desk pedestal each is provided with a floor that is split in two along its length from front to back and hinged along its side edges or along its width side-to-side and hinged along the front and back edges. A retainer when in place keeps this floor up and functional. When the retainer is removed, the floor sections rotate down along their respective hinge joints and hang into the next lower drawer flat against its side walls or front and back walls. This gangs the two drawers together effectively as one, deeper drawer. Two, three or more drawers may be ganged together in this manner. In one variation, the floor is split in two along its width from side to side and each part is sub-divided into hinged plates.

50 Claims, 9 Drawing Figures

DRAWER ASSOCIATING CONSTRUCTION

BACKGROUND OF THE INVENTION

Office desk 10, pedestals 12 and filing cabinets often, whether made of sheet steel (as is more common), wood, or the like often include, as is illustrated in FIG. 1, a tier of several individual drawers 14 of like downwardly increasing depths. In this widely used construction, the drawer 14 each have roller tracks 16 running along the side walls 18, via which the drawers are individually hung between opposed interior side walls 20 of the pedestal 12 or case so that each may be individually slid out and in.

An often encountered problem is the need for the user of an office desk or filing cabinet to store something in it that is much too deep for its drawers. An example is the need for a user to file vertically in the desk pedestal or filing cabinet sheets 22 of electronic data processing print-out paper, as sheets or bound, (hereinafter called "E.D.P. print-out paper"). As can be seen from FIG. 1, the E.D.P. print-out paper 22, when turned on one side edge would fit in a single drawer 14 widthwise of the drawer, but would be far too tall to fit.

SUMMARY OF THE INVENTION

The present invention seeks to solve the above problem by giving one or more of the upper drawers hinged "trap door" bottoms which can be selectively lowered when desired, thus ganging the respective upper and lower drawer or drawers together and effectively creating correspondingly less individual drawers of correspondingly greater depth.

One or more upper hung drawers in a single tier as in a file cabinet or desk pedestal each is provided with a floor that is split in two along its length from front to back and hinged along its side edges. A retainer when in place keeps this floor up and functional. When the retainer is removed, the floor sections rotate down along their respective hinge joints and hang into the next lower drawer flat against its side walls. This gangs the two drawers together effectively as one, deeper drawer. Two, three or more drawers may be ganged together in this manner. In one variation, the floor is split in two along its width from side to side and each part is subdivided into hinged plates.

The invention may be employed both for retrofitting existing filing drawers and for the construction of new desks and filing cabinets.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 1 is a fragmentary perspective view of a desk having a three drawer filing cabinet as one pedestal thereof, a sheet of E.D.P. paper stock being ranked beside the pedestal to illustrate a problem often encountered. The middle drawer is shown pulled out part way to expose some conventional details being referred to.

Figure 1:
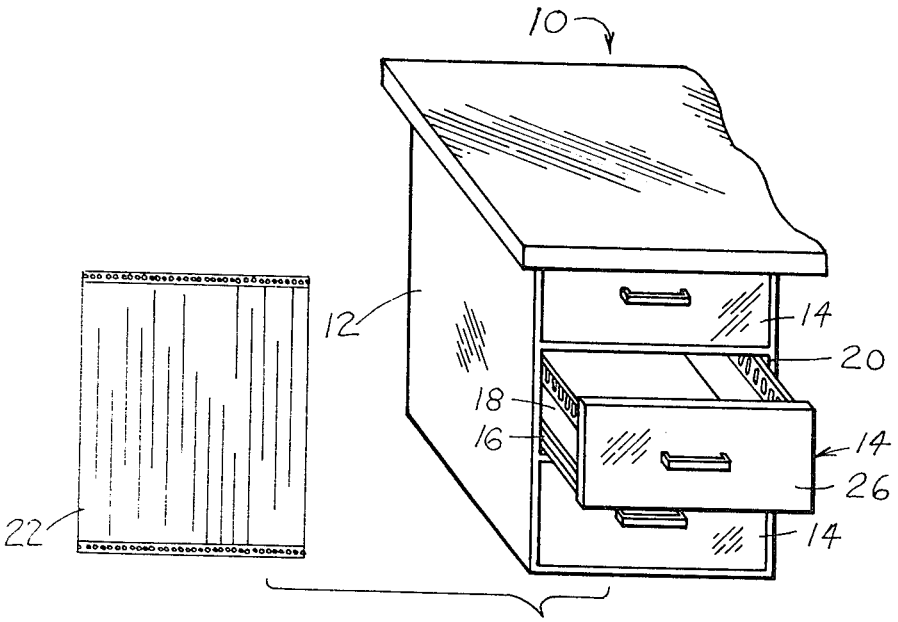
Figure 2:
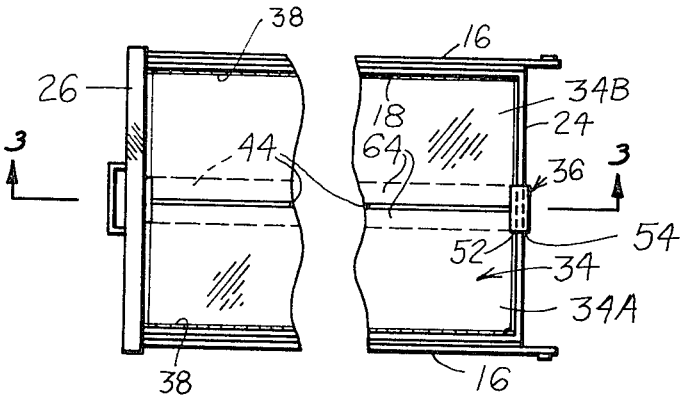
FIG. 2 is a fragmentary top plan view of one of the drawers after its modification in accordance with the principles of the invention.
Figure 3:
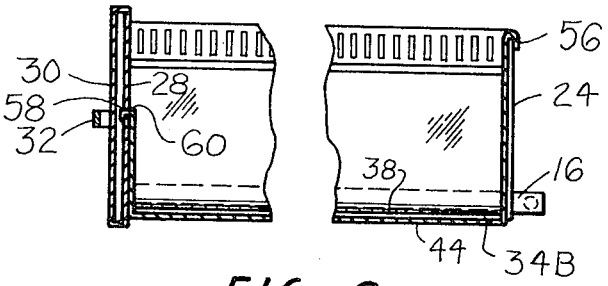
FIG. 3 is a fragmentary longitudinal sectional view of that drawer taken on line 3—3 of FIG. 2.
Figure 4:
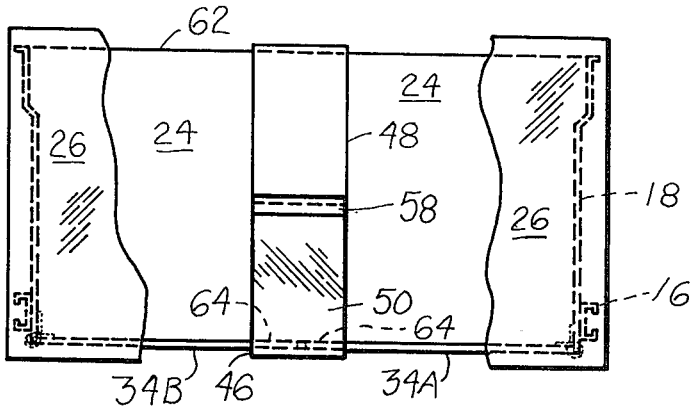
FIG. 4 is a front elevational view of that drawer with part of the drawer front broken away to expose interior details.

DETAILED DESCRIPTION OF THE PRESENTLY PREFERRED EMBODIMENT (A description will be made relative to one upper individual drawer 14 and its respectively next lower neighboring drawer 14. The same principles apply to that next lower drawer and its respectively next lower neighboring drawer 14 for as many drawers as are equipped using the principles of the invention, i.e. for ganging together 2, 3 or more individual drawers.)

(In the office furniture trade, a relatively shallow drawer is known as a "box" drawer and a somewhat deeper drawer is called a "file" or "letter" drawer. As even deeper drawer may be known as an "EDP" drawer. So far as office furniture is concerned, the principles of the invention may be employed on any and all of such drawers in all possible combinations. Further it is true that some drawers are shorter front-to-back than they are wide side-to-side, other drawers are about equal in these dimensions and in still others, the situation is reversed. References to particular sorts of drawers, i.e. office furniture filing cabinet drawers that are longer than wide, in the following description are for convenience in illustration. Of course, the invention is applicable to drawers made of any material used to manufacture drawers; wood, plastic, rubber, steel and aluminum being non-limiting examples.)

A typical drawer 14 includes two opposed upstanding side walls 18, each with a mounting means, e.g. a roller track provided on the outside thereof. In addition, the drawer 14 typically includes a rear wall 24 which is about as tall as the side walls 18, and a front 26. Typically, the front 26 is of hollow, double wall construction so as to provide both a front wall 28 for the drawer interior and a drawer front 30 for the pedestal or case in which the drawer 14 is received. Typically, a drawer pull 32 is provided on the outside of the drawer front, and the front 26 is both taller and somewhat wider than the transverse vertical cross-sectional figure of the individual drawer proper extending back of the drawer front.

Now to what is different.

In place of the usual drawer bottom, each of one or more of the upper drawers 14 is provided with a "trap-door" floor 34 and removable retainer means 36 for releasably supporting the floor 34 in a normal, "up" position.

Figure 5:
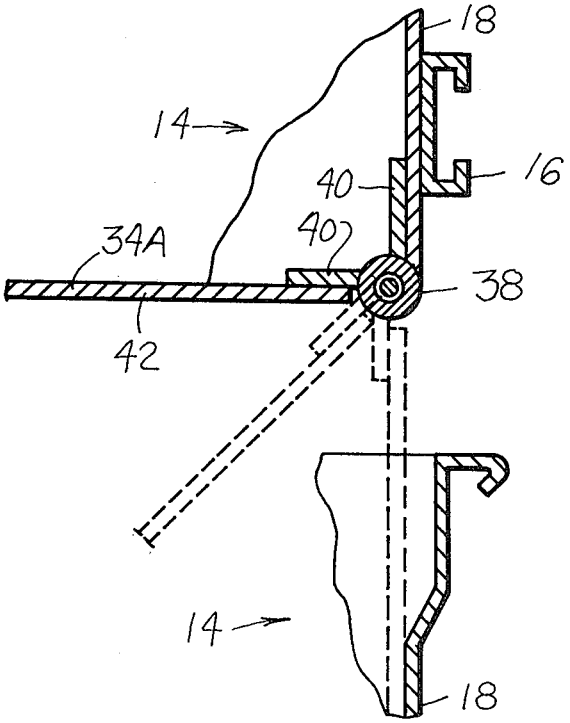
FIG. 5 is a larger scale vertical transverse cross-sectional view illustrating how that drawer becomes associated with the one below it as the upper drawer's floor is collapsed about the side hinges.

By preference, the floor 34 is provided in two side-by-side halves 34A, 34B each of which is hinged at 38 along the base of a respective side wall 18. As shows best in FIG. 5, preferably each hinge 38 is a so-called piano hinge which extends from the front to the back of the respective floor half and side wall. The hinge plates 40, in the case of metal drawers, are tack welded on the inside of the side walls and floor, i.e. on the upper surface of the floor bordering its side edges, so that when the floor sections are released to hang down their outer, formerly lower surfaces 42 come to rest against the inner surfaces of the side walls of the respectively next lower drawer so that substantially all of the inner space of the combined drawers remains useful.

A preferred means 36 for retaining the drawer trap door bottom in a raised, useful-as-a-bottom condition is shown being constituted by a removable strap 44 and means for removably mounting the strap 44 in place.

As shown the strap 44 is made of sheet or plate steel to include an elongated, flat, horizontal main portion 46, typically three inches wide, a rear wall hooking flange 48 and a front wall hooking flange 50. The main portion 46 is as long front-to-rear as is the drawer bottom. The rear wall hooking flange 48 is formed by bending the strap up along a transverse line 52, then doubling outward and downwards along a transverse line 54 a short portion 56. The front wall hooking flange 50 is similarly formed so as to have a tang 58.

If necessary, the drawer bottom 34 may be notched or gapped from the drawer front and drawer back at least in the vicinity of its longitudinal centerline, in order to accommodate assembly of the strap 44 therewith.

Preferably, the inner wall 28 of the drawer front 26 is centrally provided midway up its height with a horizontal, laterally extending slot 60.

For normal use as an individual drawer, the drawer bottom sections 34A, 34B are folded up along the hinges 38 and the strap 44 is installed by inserting its front wall hooking flange 50 tang 58 in the slot 60, and catching the rear wall hooking flange 48 on the upper edge 62 of the drawer rear wall along the centerline of the drawer. Then the two drawer bottom sections 34A, 34B are folded flat so that their centrally located edge regions 64 come to rest upon the strap 44 main portion 56.

When so assembled, each drawer 14 may be used as an individual drawer, for as long as desired, even for many years. Whenever, and for however long it is desired to gang two or more individual drawers 14 together to create effectively less individual drawers but one or more deeper ones, the respective strap or straps 44 are removed by reversing the above procedure, and the respective drawer bottom sections 34A, 34B are permitted to pivot downwards (see the dashed lines in FIG. 5). Because the bottom sections 34A, 34B are substantially as long as the drawer interiors, and, when lowered each such section of an upper drawer depends far enough downwards to be caught between the front and rear walls of the next lower drawer 14, a single composite has been made of the plurality of drawers. Pulling on one hand 32 will pull out the whole composite, so that if the individual drawers were two box drawers, a file drawer has been created. If a file drawer has been effectively deepened by ganging another drawer thereto by dropping the "trap-door" bottom of the upper one of them, such a deep composite drawer may be created that tall items, such as E.D.P. print-out paper may be stored therein and retrieved therefrom.

Should there come a time when such drawer depth is no longer needed, the individual drawers 14 may be restored to their original separate status by reinstalling the strap or straps 44 according to the above procedure.

Figure 6:
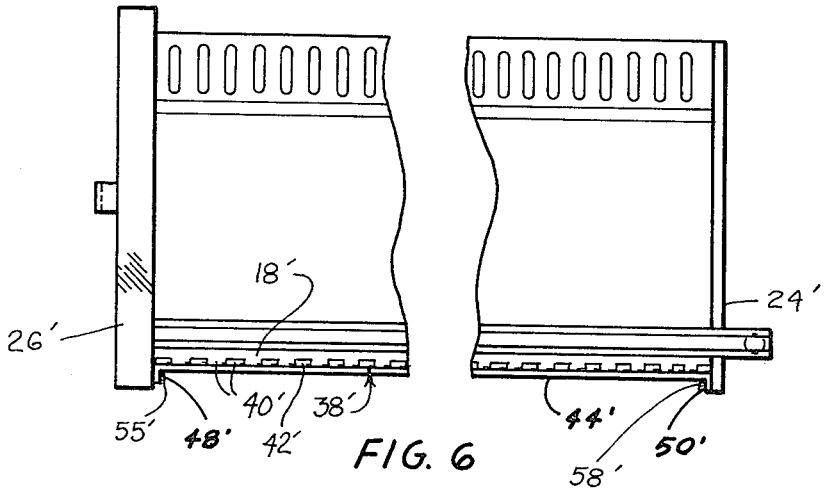
FIG. 6 is a side elevation view of another version of the drawer, illustrating some individually alternatively useful features, with the drawer bottom being somewhat differently hinged and the support bar having another form of removable securement to the drawer.

FIG. 6 is provided so that two alternative features independently usable on any of the embodiments shown can be described.

First, note that as shown in FIG. 6, the piano hinges 38' are eliminated as separate elements by making their hinge plates 40' integral with the respective side walls 18' and drawer bottom 42' at the side margins of the bottom.

Second, note that the way the floor halves are kept up in their horizontal, supporting condition is somewhat different. in particular, the retainer 44' is releasably mounted entirely under the drawer bottom by having down-turned tang portions 48', 50' at its respective ends, respectively releasably secured, e.g. by screws, bolts or similar fasteners 55', 58' secured to the front 26' and rear 24'. The screws or the like are installed or engaged to hold the retainer in place and are removed or released to permit removal or release of the retainer. The retainer need not be fully physically separable from all of the drawer. For instance, when released, it could remain secured to one of the floor sections 34A, 34B.

Figure 7:
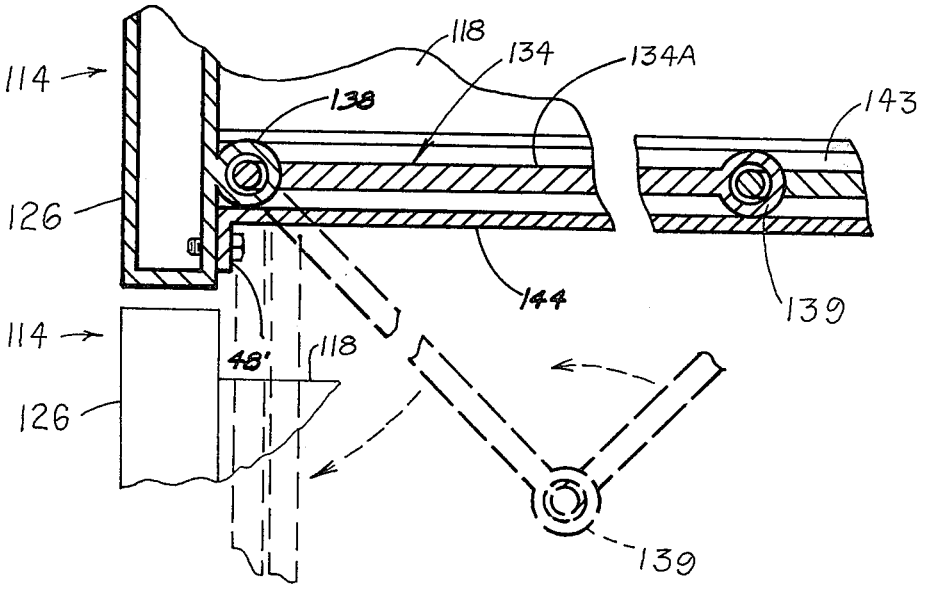
FIG. 7 is a fragmentary transverse vertical sectional view, similar to the full line upper portion of FIG. 5, but of the embodiment shown in FIG. 8.
Figure 8:
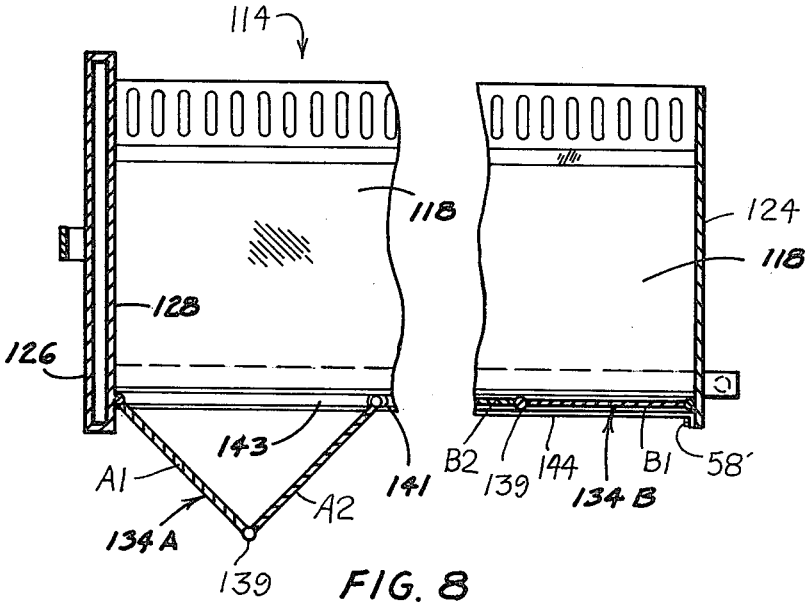
FIG. 8 is a longitudinal vertical sectional view of the FIG. 7 embodiment, wherein the hinged "trap-door" drawer bottom is split transversally, each half is also hinged along transverse hinge lines intermediate its length and the resulting drawer bottom plates are guided in roller tracks, in this view the front half (at the left in the Figure) being shown partially collapsed and the rear half (at the right in the Figure) being shown fully up in horizontal, supporting condition.
Figure 9:
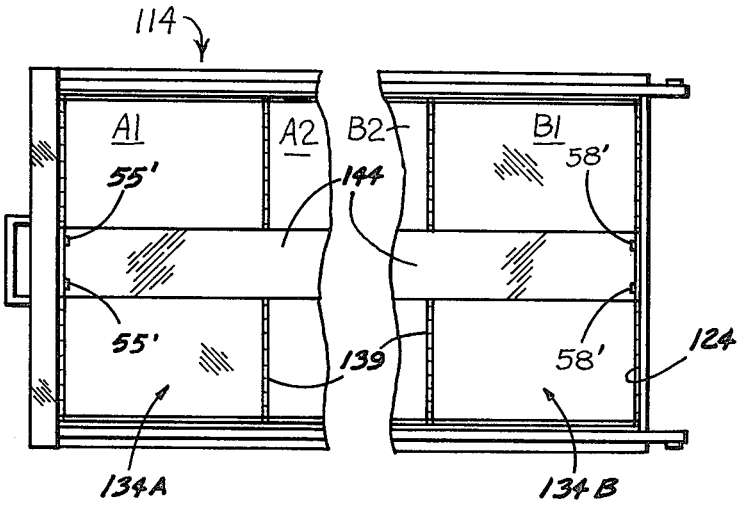
FIG. 9 is a bottom plan view of the drawer shown in FIG. 8, with both halves of the drawer being fully up in supporting condition and the support strap being shown secured in place.

Another independently useful alternative feature is illustrated in FIGS. 7, 8 and 9.

In FIGS. 7, 8 and 9 the drawer bottom 134 is split transversally intermediate the length of the drawer 114 into two sections 134A, 134B. The front edge of the front section 134A is hinged to the back 128 of the drawer front 126 (and/or to the two side walls 118). The rear edge of the rear section 134B is hinged to the front of the drawer back 124 (and/or to the two side walls 118).

By preference, the sections 134A, 134B are further sub-divided by intermediate hinges 139 extending transversally thereof intermediate the lengths thereof, into pivotally longitudinally adjoining plates A1, A2 and B1, B2.

The rear edge of the front section 134A and the front edge of the rear section 134B are, at their respective side margins, shown provided with respective glides or rollers 141, which are guidingly received in respective tracks 143 provided on the inner faces of the drawer side walls 118.

Normally, the four plates A1–B2 are horizontally disposed in generally the same plane and a retainer 144 is in place holding them there. (In the instance illustrated, the retainer 144 is substantially identical to the retainer 44' shown in FIGS. 6 and 7 and is removably installed the same way, as shown in FIG. 9.)

With the embodiment of FIGS. 8 and 9, when it is desired to gang two vertically adjoining drawers together, the "trap-door" floor of the relatively upper one of them is collapsed, accordian door-style, by releasing the retainer 144 (and removing it if it is designed to be removed). Then the two sections 134A, 134B may be respectively buckled downwards along their hinges 139. This causes the rear edge of the front section 134A to come to rest adjacent the front edge of the front section, and the front edge of the rear section 134B to come to rest near the rear edge of the rear section. In these latter positions, the now-lowermost region of each doubled-over section depends into adjacency with the inner face of the respective drawer front and drawer back. The net effect is much as depicted in and as described with respect to FIG. 5. Either the various hinges may be so constricted as to ensure that so long as the floor plates are collapsed the drawers are ganged together, or means (not illustrated) may be provided for securing the collapsed floor plates of the upper drawer to the front and/or rear walls and/or to the side walls of the associated relatively lower drawer.

Although the invention has been described in the context of office equipment, e.g. desk pedestals and filing cabinets, the principles of the invention may be put to work anywhere there are two or more vertically superimposed drawer or drawer-like members in a frame or case member. For instance the invention may be put to use in the fields of kitchen and food service cabinetry for homes, airlines and institutions; lab, hospital and medical care cabinetry; industrial materials handling and storage units; library and educational cabinetry; and home storage and workshop cabinetry and the like.

Although the invention has been described so far as if the basic unit were a single drawer with a releasable retainer for its split, hinged "trap-door" bottom, or two or more drawers stacked in a frame or case wherein each or at least one relatively upper drawer is provided with a releasable retainer for its split, hinged "trap-door" bottom, another merchandising and use concept should now be apparent. That is, the principles of the invention permit a manufacturer or retailer to make or stock one design of desk pedestal, filing cabinet or the like and to furnish it variously equipped to suit the needs of the customer. For instance, someone who wanted all shallow drawers could be sold the pedestal with all retainers in place so that each drawer functioned as an individual. Someone else who wanted one or more deep drawers could be sold the same desk pedestal or the like, but with two or more of the individual drawers already ganged together. The latter customer thus might never see a retainer 44, 44' or 144, or even be aware of the existence thereof. further, in such an instance retainers could be sold as optional extras for use when desired. In that broad sense and in such instances, the retainer need not be considered a fundamental or essential element of the invention. In any of the disclosed versions, there are instances where the floor may be constituted by only one hinged section, whether or not that section is also intermediately hinged.

It should now be apparent that the drawer associating construction as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

It is claimed:

1. A drawer, having:

two opposed side walls, an upstanding front wall and an upstanding rear wall, and a trap-door floor constituted by at least one floor section hingedly secured along an outer edge thereof to a respective one of said upstanding walls, the aforementioned hinged securement being provided by hinge means which permit said at least one floor section, unless otherwise releasably held up in a generally horizontal relation for use as a bottom wall for said drawer, to hang down below said upstanding walls;

ganging means on said trap door floor, operable only when said bottom wall is hanging down below said upstanding walls, for connecting said drawer, as an upper drawer, with an underlying drawer, so that said upper drawer if pulled-out and pushed-in will cause the underlying drawer to be correspondingly pulled-out and pushed-in and so that said upper drawer, in effect then operates as an upward wall extension means of the underlying drawer to make the underlying drawer effectively deeper.

2. A drawer, having:

two opposed upstanding side walls, an upstanding front wall and an upstanding rear wall constituting two pairs of opposed upstanding walls, and a trap-door floor split into at least two sections, each section being hingedly secured along an outer edge thereof to a respective one of said upstanding walls of one of said pairs thereof; and means for releasably holding said floor sections in generally horizontal relation for use as a bottom wall for said drawer, the aforesald hinged securement being provided by hinge means which permit said floor sections, when said releasably holding means is released therefrom, to pivot free of one another and downwards so as to hang below said upstanding walls.

3. The drawer of claim 2, wherein:

said hinge means are constituted by two respective piano hinges.

4. The drawer of claim 2, wherein:

the releasably holding means is constituted by:

a support strap having a main portion extending longitudinally under the floor in supporting relation to both floor sections; and means releasably securing said support strap in said supporting relation.

5. A drawer, having:

two opposed upstanding side walls, an upstanding front wall and an upstanding rear wall, and a trap-door floor split longitudinally into two side-by-side sections, each section being hingedly secured along an outer side edge thereof to a respective one of said upstanding side walls; and means for releasably holding said floor sections in generally horizontal relation for use as a bottom wall for said drawer, the aforesaid hinged securement being provided by hinge means which permit said floor sections, when said releasably holding means is released therefrom, to pivot free of one another and downwards so as to hang below said upstanding side walls.

6. The drawer of claim 5, wherein:

said hinge means are constituted by two respective piano hinges.

7. The drawer of claim 5, wherein:

the releasably holding means is constituted by:

a support strap having a main portion extending longitudinally under the floor in supporting relation to both floor sections proximally of said split; and means releasably securing said support strap in said supporting relation.

8. The drawer of claim 7, wherein:

the means releasably securing said support strap in said supporting relation comprises:

a rear wall hooking means secured to said main portion and removably hooked upon said upstanding rear wall; and a front wall hooking means secured to said main portion and removably hooked upon said upstanding front wall.

9. The drawer of claim 8, wherein:

there is provided means defining a first slot between said floor and said upstanding rear wall; and there is provided means defining a second slot between said floor and said upstanding front wall;

the support strap being constituted by a one-piece strap having both said wall hooking means integrally joined with said main portion.

10. The drawer of claim 9, wherein:

the support strap is constituted by a strap of steel having two upwardly bent portions one at the front and the other at the rear thereof; each upwardly bent portion being partially doubled back along a transversally extending horizontal axis to provide respective hooks.

11. A drawer, having:

two opposed upstanding side walls, an upstanding front wall and an upstanding rear wall, and a trap-door floor split transversally into two sections, each section being hingedly secured along an outer edge thereof to a respective one of said upstanding front and rear walls; and means for releasably holding said floor sections in generally horizontal relation for use as a bottom wall for said drawer, the aforesaid hinged securement being provided by hinge means which permit said floor sections, when said releasably holding means is released therefrom, to pivot free of one another and downwards so as to hang below said upstanding walls.

12. The drawer of claim 11, wherein:

said hinge means are constituted by two respective piano hinges.

13. The drawer of claim 11, wherein:

the releasably holding means is constituted by:

a support strap having a main portion extending longitudinally under the floor in supporting relation to both floor sections; and means releasably securing said support strap in said supporting relation.

14. The drawer of claim 11, further including:

at least one of said two floor sections being further transversally divided into two plates which are hinged together to provide a first plate having said outer edge and a second plate having a hinge between them;

cooperative track means and guide means being provided on said two upstanding side walls and on said second plate at the opposite side margins of the second plate, so that as said at least one floor section is released said guide means move along said track means as said at least one floor section doubles over about said hinge between said two plates thereof, with this latter hinge becoming disposed at a lower level as a result.

15. The drawer of claim 14, wherein:

the releasably holding means is constituted by:

a support strap having a main portion extending longitudinally under the floor in supporting relation to both floor sections; and means releasably securing said support strap in said supporting relation.

16. In combination, a frame;

two vertically superimposed drawers slidably mounted in said frame;

the upper one of said two drawers having hinged panel means thereof removably depending into the lower one of said two drawers thus constituting means ganging the respective upper and lower drawers together so as to automatically effect the same pushing in and pulling out of both if either is pushed in or pulled out for so long as said hinged panel means depends as aforesaid.

17. In a furniture article, including a case having at least one tier of individual drawers including at least one relatively upper drawer and at lease one respectively next lower drawer;

each drawer having:

two upstanding side walls, an upstanding front wall, an upstanding rear wall constituting two pairs of opposed upstanding walls, and a floor;

both drawers being supported by support means in the case for being pulled out for access thereto and pushed in for storage thereof, the support means for at least each said at least one upper drawer being mounted to the side walls of that drawer;

the improvement wherein:

in the instance of said at least one relatively upper drawer, the floor thereof is constituted by a trap-door floor split into at least two sections, each section being hingedly secured along an outer edge thereof to a respective one of said upstanding walls of one of said pairs thereof; and means for releasably holding said floor sections in generally horizontal relation for use as a bottom wall for said drawer, the aforesaid hinged securement being provided by hinge means which permit said floor sections, when said releasably holding means is released therefrom, to pivot downwards so as to hang below said upstanding side walls;

each floor section, when the respective said releasably holding means is released, depending into the respectively next lower drawer to lie adjacent the inside of a respective said upstanding wall of said respectively next lower drawer, so that when said relatively upper drawer for which the respective said releasably holding means has been released is pulled out, the respective next lower drawer is ganged thereto and effectively constitutes a deeper drawer therewith.

18. The furniture article of claim 17, wherein:

said case constitutes a desk pedestal.

19. The furniture article of claim 17, wherein:

said case constitutes a filing cabinet.

20. The furniture article of claim 17, wherein:

there are three vertically adjacent drawers in said tier, so that there are two of said relatively upper drawers and two of said respectively next lower drawers, of which the one drawer which is intermediate the other two in said tier of three is both a relatively upper drawer and a respectively next lower drawer.

21. The furniture article of claim 17, wherein:

said hinge means are constituted by two respective piano hinges.

22. In a furniture article, including a case having at least one tier of individual drawers including at least one relatively upper drawer and at least one respectively next lower drawer;

each drawer having:

two upstanding side walls, an upstanding front wall, and an upstanding rear wall and a floor;

both drawers being supported by support means in the case for being pulled out for access thereto and pushed in for storage thereof, the support means for at least each said at least one upper drawer being mounted to the side walls of that drawer;

the improvement wherein:

in the instance of said at least one relatively upper drawer, the floor thereof is constituted by a trapdoor floor split longitudinally into two side-by-side sections, each section being hingedly secured along an outer side edge thereof to a respective one of said upstanding side walls; and means for releasably holding said floor sections in generally horizontal relation for use as a bottom wall for said drawer, the aforesaid hinged securement being provided by hinge means which permit said floor sections, when said releasably holding means is released therefrom, to pivot downwards so as to hang below said upstanding side walls;

each floor section, when the respective said releasably holding means is released, depending into the respectively next lower drawer to lie adjacent the inside of a respective said side wall of said respectively next lower drawer, and extend from adjacent the inside of the front wall to adjacent the inside of the rear wall thereof, so that when said relatively upper drawer for which the respective said releasably holding means has been released is pulled out, the respective next lower drawer is ganged thereto and effectively constitutes a deeper drawer therewith.

23. The furniture article of claim 22, wherein:

said case constitutes a desk pedestal.

24. The furniture article of claim 22, wherein:

said case constitutes a filing cabinet.

25. The furniture article of claim 22, wherein:

there are three vertically adjacent drawers in said tier, so that there are two of said relatively upper drawers and two of said respectively next lower drawers, of which the one drawer which is intermediate the other two in said tier of three is both a relatively upper drawer and a respectively next lower drawer.

26. The furniture article of claim 22, wherein:

said hinge means are constituted by two respective piano hinges.

27. The furniture article of claim 22, wherein:

the releasably holding means for each relatively upper drawer is constituted by:

a support strap having a main portion extending longitudinally under the floor thereof in supporting relation to both floor sections thereof proximally of said split thereof; and means releasably securing said support strap in said supporting relation.

28. The furniture article of claim 27, wherein:

said means releasably securing said support strap in said supporting relation comprises:

a rear wall hooking means secured to said main portion and removably hooked upon said upstanding rear wall thereof; and a front wall hooking means secured to said main portion and removably hooked upon said upstanding front wall thereof.

29. The furniture article of claim 28, wherein:

on each said relatively upper drawer there is provided means defining a first slot between said floor thereof and said upstanding rear wall thereof; and there is provided means defining a second slot between said floor thereof and said upstanding front wall thereof;

the support strap being constituted by a one-piece strap having both said wall hooking means integrally joined with said main portion.

30. The furniture article of claim 29, wherein:

the support strap is constituted by a strap of steel having two upwardly bent portions one at the front and the other at the rear thereof; each upwardly bent portion being partially doubled back along a transversally extending horizontal axis to provide respective hooks.

31. In a furniture article, including a case having at least one tier of individual drawers including at least one relatively upper drawer and at least one respectively next lower drawer;

each drawer having:

two upstanding side walls, an upstanding front wall, an upstanding rear wall and a floor;

both drawers being supported by support means in the case for being pulled out for access thereto and pushed in for storage thereof, the support means for at least each said at least one upper drawer being mounted to the side walls of that drawer;

the improvement wherein:

in the instance of said at least one relatively upper drawer, the floor thereof is constituted by a trapdoor floor split into two sections, each section being hingedly secured along an outer edge thereof to a respective one of said upstanding front and rear walls; and means for releasably holding said floor sections in generally horizontal relation for use as a bottom wall for said drawer, the aforesaid hinged securement being provided by hinge means which permit said floor sections, when said releasably holding means is released therefrom, to pivot downwards so as to hang below said upstanding walls;

each floor section, when the respective said releasably holding means is released, depending into the respectively next lower drawer to lie adjacent the inside of a respective said upstanding wall of said respectively next lower drawer, so that when said relatively upper drawer for which the respective said releasably holding means has been released is pulled out, the respective next lower drawer is ganged thereto and effectively constitutes a deeper drawer therewith.

32. The furniture article of claim 31, wherein:

said case constitutes a desk pedestal.

33. The furniture article of claim 31, wherein:

said case constitutes a filing cabinet.

34. The furniture article of claim 31, wherein:

there are three vertically adjacent drawers in said tier, so that there are two of said relatively upper drawers and two of said respectively next lower drawers, of which the one drawer which is intermediate the other two in said tier of three is both a relatively upper drawer and a respectively next lower drawer.

35. The furniture article of claim 31, wherein:

said hinge means are constituted by two respective piano hinges.

36. The furniture article of claim 31, wherein:

the releasably holding means for each relatively upper drawer is constituted by:

a support strap having a main portion extending longitudinally under the floor thereof in supporting relation to both floor sections thereof; and means releasably securing said support strap in said supporting relation.

37. The furniture article of claim 31, wherein:

in the instance of said at least one relatively upper drawer, at least one of said two floor sections being further transversally divided into two plates which are hinged together to provide a first plate having said outer edge and a second plate having a hinge between them;

cooperative tracks means and guide means being provided on said two upstanding side walls and on said second plate at the opposite side margins of the second plate, so that as said at least one floor section is released said guide means move along said track means as said at least one floor section doubles over about said hinge between said two plates thereof, with this latter hinge becoming disposed at a lower level as a result.

38. The furniture article of claim 37, wherein:

in the instance of said at least one relatively upper drawer, the releasably holding means is constituted by:

a support strap having a main portion extending longitudinally under the floor in supporting relation to both floor sections; and means releasably securing said support strap in said supporting relation.

39. A drawer assembly, comprising:

a first, upon drawer member including two upstanding side walls, an upstanding front wall and an upstanding rear wall;

a second, lower drawer member including two upstanding side walls, an upstanding front wall and an upstanding rear wall;

said first, upper drawer member being in vertical juxtaposition with said second, lower drawer member;

said second, lower drawer member further including a floor; and said drawer assembly further including at least one securement member effectively releasably ganging at least one said wall of said first, upper drawer member to at least one said wall of said second, lower drawer member, so that pulling-out and pushing-in of either of said drawer members while said drawer members are so releasably ganged together will serve to pull out and push in both of said drawer members as a unit.

40. The drawer assembly of claim 39, wherein:

said securement member releasably gangs together with said at least one said wall of said first, upper drawer member, the comparable said at least one wall of said second, lower drawer member.

41. The drawer assembly of claim 40, wherein:

said at least one securement member comprises a panel means removably secured to a said side wall of said first, upper drawer member and depending into said second, lower drawer member in adjacency with the comparable at least one side wall of said second, lower drawer member.

42. A drawer assembly, comprising:

two drawers in vertically stacked relation, the upper one of which is lacking a drawer bottom in normal, article-supporting relation, so that there is open communication down through said upper drawer with the respective lower drawer; and means ganging said two drawers together so that pulling-out and pushing-in either one of said drawers pulls-out and pushes-in both of said drawers.

43. The drawer assembly of claim 42, wherein:

said ganging means is mounted to said upper drawer where a drawer bottom normally would be mounted to said upper drawer.

44. The drawer assembly of claim 43, wherein:

said ganging means depends from said upper drawer into said lower drawer for ganging said two drawers together.

45. A drawer assembly, comprising:

an upper, bottomless drawer in vertically stacked relation with a lower bottomed drawer; and a securement member releasably ganging said upper drawer to said lower drawer so that pulling-out and pushing-in either drawer correspondingly pulls-out and pushes-in both of said drawers.

46. The drawer assembly of claim 45, wherein:

means selectively releasing said securement member from ganging relation with said lower drawer and correspondingly converting said securement means into a bottom for said upper drawer.

47. A furniture article comprising:

a case having two drawers slidably received therein in vertically superimposed relation;

means separately slidably mounting each drawer relative to the case; and means ganging the upper one of said drawers to the lower one of said drawers and preventing relative movement therebetween in a push-pull sense so that when one of them is pulled-out and pushed-in, the other of them is correspondingly pulled-out and pushed-in.

48. The furniture article of claim 47, wherein:

said upper drawer is provided with a convertible bottom which is shiftable between a first position in which it separates the upper drawer from the lower drawer and a second position in which it does not separate the upper drawer from the lower drawer.

49. The furniture article of claim 47, wherein:

said ganging means releasably gangs the upper one of said drawers to the lower one of said drawers.

50. In combination, a frame;

two vertically superimposed drawers slidably mounted in said frame;

the upper one of said two drawers having panel means thereof removably depending into the lower one of said two drawers and ganging the respective upper and lower drawers together for so long as said panel means depends as aforesaid;

so that when either one of said two drawers is pulled-out and pushed-in, the other one of them also is correspondingly pulled-out and pushed-in.

* * * * *